United States Patent [19]

Ragland, Jr.

[11] Patent Number: 4,613,785

[45] Date of Patent: Sep. 23, 1986

[54] COLOR PICTURE TUBE HAVING AN IMPROVED SIMPLIFIED SUPPORT STRUCTURE FOR A COLOR SELECTION ELECTRODE

[75] Inventor: Frank R. Ragland, Jr., Manheim Township, Lancaster County, Pa.

[73] Assignee: RCA Corporation, Princeton, N.J.

[21] Appl. No.: 594,850

[22] Filed: Mar. 29, 1984

[51] Int. Cl.[4] ..... H01J 29/07

[52] U.S. Cl. ..... 313/405; 313/406; 313/407

[58] Field of Search ..... 313/402, 404, 405, 407, 313/406

[56] References Cited

U.S. PATENT DOCUMENTS

| | | | |
|---|---|---|---|
| 3,330,980 | 7/1967 | Shrader | 313/85 |
| 3,487,251 | 12/1969 | Barten et al. | 313/85 |
| 3,524,973 | 8/1970 | Rigdon | 313/85 |
| 3,639,798 | 2/1972 | Miller | 313/85 S |
| 3,754,157 | 8/1973 | Yamazaki et al. | 313/85 S |
| 3,803,436 | 4/1974 | Morrell | 313/85 S |
| 3,890,526 | 6/1975 | Palac | 313/408 |
| 3,894,260 | 7/1975 | Sedivy | 313/405 |
| 3,986,071 | 10/1976 | Groot | 313/404 |
| 3,986,072 | 10/1976 | Adamski | 313/404 |
| 4,528,475 | 7/1985 | Ragland, Jr. | 313/407 X |
| 4,572,983 | 2/1986 | Ragland, Jr. | 313/407 X |

OTHER PUBLICATIONS

A Morrell, H. Law, E. Ramberg and E. Herold, *Color Television Picture Tubes*, 100–102, 104–107, Academic Press (1974).

*Primary Examiner*—David K. Moore
*Assistant Examiner*—K. Wieder
*Attorney, Agent, or Firm*—Eugene M. Whitacre; Dennis H. Irlbeck; Vincent J. Coughlin, Jr.

[57] ABSTRACT

An improved color picture tube according to the invention includes an evacuated envelope enclosing a substantially rectangular cathodoluminescent screen, a color selection electrode suspended in register with the screen by a support structure, and an electron gun. The support structure includes a plurality of studs attached to the envelope adjacent to the corners of the screen and a plurality of springs connecting the color selection electrode to the studs. Each spring is a bimetal member of laminated construction having two layers of dissimilar metal joined along facing surfaces. Each of the springs has a proximal end attached at an angle to the color selection electrode and a distal end with an aperture therethrough which pivotably engages one of the studs. Each of the springs includes a step-like portion formed therein. The springs provide longitudinal and rotational compensation to maintain the color selection electrode in register with the screen when the color selection electrode and the springs are heated.

4 Claims, 5 Drawing Figures

COLOR PICTURE TUBE HAVING AN IMPROVED SIMPLIFIED SUPPORT STRUCTURE FOR A COLOR SELECTION ELECTRODE

BACKGROUND OF THE INVENTION

This invention relates to color picture tubes of the type having a color selection electrode or shadow mask attached to a frame which is suspended in relation to a cathodoluminescent screen, and particularly to a simplified support structure for suspending the mask-frame assembly within the tube.

In these color picture tubes, the accuracy with which the electron beams strike the individual elemental cathodoluminescent screen areas depends, to a great extent, upon the accuracy with which the apertures in the shadow mask are aligned with the elemental screen areas during the operation of the tube. Thus, as the mask expands outwardly, i.e., radially, by reason of thermal effects occasioned by the impact thereon of the electron beams, the resulting misalignment of the mask apertures and elemental screen areas cause a portion of the electron beams to misregister, that is, to impinge upon elemental screen areas other than the ones upon which they are intended to impinge.

Most present day color picture tubes utilize a mask mounting assembly, such as described in U.S. Pat. No. 3,803,436, issued to Morrell on Apr. 9, 1974, to move the mask longitudinally towards the screen, as the mask is heated, to compensate for radial mask expansion. In FIGS. 1–4 of the Morrell patent, bimetallic elements are connected between studs embedded in the faceplate panel and the mask electrode. The bimetallic elements may be springs welded directly to the frame or intermediate members located between the springs and the frame. In the Morrell patent, the studs are located along the major and minor axes of the faceplate panel. Such a structure produces some instability and loss of rigidity in the mask electrode. The Morrell patent also discloses an arrangement for compensating for both radial and transverse misregister in a three-point mount rectangular tube. That structure is shown in FIGS. 14 and 15 of the Morrell patent. A more complete description of mask mounting structures and temperature compensation may be found in A. Morrell, H. Law, E. Ramberg and E. Herold, *Color Television Picture Tubes,* 100–102, 104–107 (Academic Press, 1974).

In a four-spring support arrangement, wherein each spring has the same orientation, e.g., all extending either clockwise or counterclockwise relative to the mask-frame assembly, thermal expansion of the springs and frame causes the mask-frame assembly to rotate about the longitudinal axis of the tube. This rotation also causes misregister of the electron beams with the elemental screen areas. The direction of rotation is determined by the location of the support structure relative to the major and minor axes of the faceplate. If the springs of the support structure are located to the right of the major and minor axes, the rotation will be oppositely directed, or clockwise. However, if the springs of the support structure are located to the left of the axes, the rotation will be counterclockwise.

A structure which corrects the aforementioned problem of rotation while providing for thermal expansion of the mask-frame assembly along the longitudinal axis is proposed in U.S. Pat. No. 4,528,475 issued on July 9, 1985, to F. R. Ragland, Jr. In the structure in that patent, an edge-to-edge bimetallic spring is angled with respect to the frame such that the angle between the spring and the frame is of an amount to align the spring-to-frame attachment point when the spring and the frame are unheated with the same attachment point when the spring and the frame are heated. In the aforementioned patent, when four studs are used to support the mask-frame assembly the studs are located adjacent to the major and minor axes of the faceplate panel. However, if the studs which support the mask-frame assembly were to be moved adjacent to the corners of the faceplate panel to increase the stability of the mask, it would be necessary to determine an angle for the springs attached along the long side of the faceplate and a different angle for the springs attached along the short side of the faceplate. The reason for the different spring angles is because of the difference in spacing from the major and minor axes to the corners of the rectangular faceplate.

Another support structure which compensates for the aforementioned problem of rotation while providing longitudinal displacement of the mask-frame assembly to correct for the thermal expansion of the mask-frame assembly is described in copending U.S. patent application Ser. No. 594,849, filed on Mar. 29, 1984, by F. R. Ragland, Jr. now U.S. Pat. No. 4,572,983. The mask-frame assembly in that application is preferably formed of cold-rolled steel which has a thermal expansion of about $33\times10^{-6}$ centimeters per °C. at 20° C. The support structure disclosed therein comprises a plurality of spring assemblies, each of which includes at least two bimetal members attached between the frame of the mask-frame assembly, and a plurality of support studs affixed to the tube envelope. In the present patent application, a low expansion mask-frame assembly is used so that the support structure does not have to provide the same magnitude of thermal correction as required for mask-frame assemblies made of cold-rolled steel. Thus, a simpler support structure which provides both longitudinal and rotational compensation can be used.

SUMMARY OF THE INVENTION

An improved color picture tube according to the invention includes an evacuated envelope enclosing a substantially rectangular cathodoluminescent screen, a color selection electrode suspended in register with the screen by support means and an electron gun. The support means includes a plurality of studs attached to the envelope adjacent to the corners of the screen and a plurality of springs connecting the color selection electrode to the studs. Each spring is a bimetal member of laminated construction having two layers of dissimilar metal joined along facing surfaces. Each of the springs has a proximal end attached at an angle to the color selection electrode and a distal end with an aperture therethrough which pivotably engages one of the studs. Each of the springs includes a step-like portion formed therein. The springs provide longitudinal and rotational compensation to maintain the color selection electrode in register with the screen when the color selection electrode and the springs are heated.

DETAILED DESCRIPTION OF THE PREFERRED EMBODIMENTS

Figure 1:
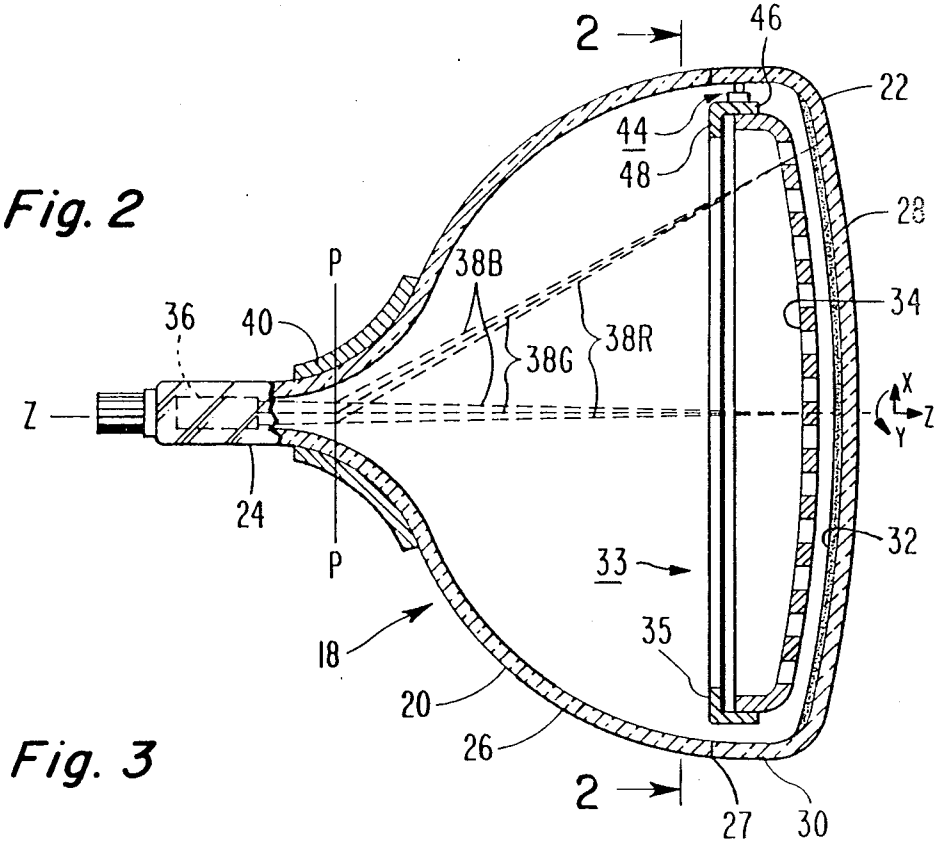
FIG. 1 is a plan view in axial section of an apertured mask cathode-ray tube (CRT).

FIG. 1 illustrates a substantially rectangular color picture tube 18 having an evacuated glass envelope 20 comprising a faceplate panel 22 and a tubular neck 24 joined by a funnel 26. The panel 22, having a major axis (X—X) and a minor axis (Y—Y), comprises a viewing faceplate 28 and a peripheral flange or sidewall 30, which is sealed to the funnel 26 by a frit material 27. A substantially rectangular three-color cathodoluminescent line screen 32 is located on the inner surface of the faceplate 28. The screen 32 comprises an array of phosphor lines extending substantially parallel to the minor axis of the panel 22, so that the major and minor axes of the screen 32 are aligned with the major and minor axes of the panel. Alternatively, the screen may comprise a mosaic pattern of phosphor dots as is known in the art. Portions of the screen 32 may be covered with a light-absorbing material (not shown). A mask-frame assembly 33, comprising a multiapertured color selection electrode or shadow mask 34, preferably of Invar (36% Ni, 64% Fe) having a thermal expansion of about $2.5\times10^{-6}$ centimeters per °C. at 20° C. is attached to a frame 35 of Invar having an L-shaped cross-section. The mask-frame assembly 33 is removably mounted within the panel 22 in predetermined spaced relationship to the screen 32. The mask-frame assembly 33 must be removed from the panel 22 several times in the process of fabricating the screen 32. A novel support structure for this mask-frame assembly 33 is described in detail below. The mask 34 includes a multiplicity of slit-shaped apertures, which are aligned in substantially parallel vertical columns, and web portions separating the slits of each column. If a dot screen is used, the apertures in the mask 34 are circular.

An inline electron gun 36 (illustrated schematically) is mounted within the neck 24 to generate and direct three inline electron beams 38B, 38R and 38G along convergent paths through the mask 34 to the screen 32. The longitudinal axis (Z—Z) of the tube 18 passes through the center of the electron gun 36 and through the center of the screen 32.

The tube 18 is designed to be used with an external magnetic deflection yoke 40 surrounding the neck 24 and funnel 26 in the vicinity of their junction. When appropriate voltages are applied to the yoke 40, the three beams 38B, 38R and 38G are subjected to orthogonal magnetic fields that cause the beams to scan in the direction of the major screen axis, and in the direction of the minor screen axis, in a rectangular raster over the screen 32. The major and minor axes of the screen 32 are mutually perpendicular to one another and to the longitudinal axis (Z—Z) of the tube 18. For simplicity, the actual curvature of the paths of the deflected beams in the deflection zone is not shown in FIG. 1. Instead, the beams are schematically shown as having an instantaneous bend at the plane of deflection (P—P).

Figure 2:
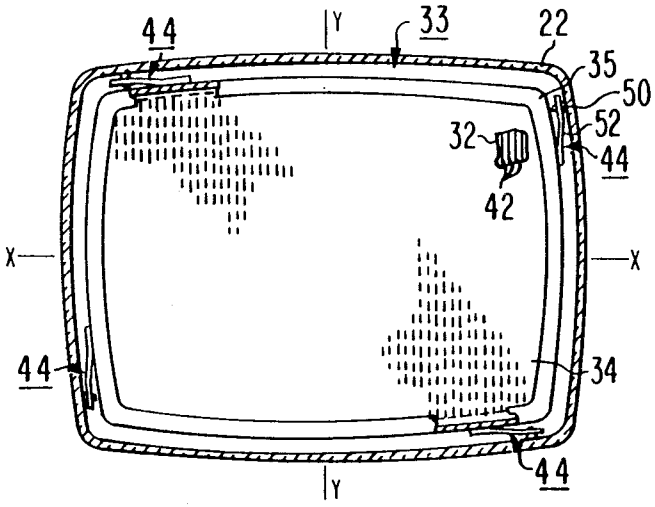
FIG. 2 is a back view of the faceplate and mask-frame assembly of the tube of FIG. 1 having a counterclockwise oriented novel support structure adjacent to each of the corners of the faceplate.
Figure 3:
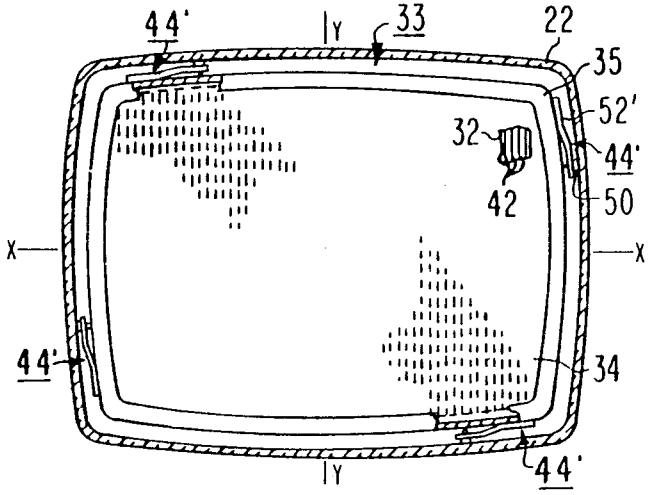
FIG. 3 is a back view of the faceplate and mask-frame assembly of the tube of FIG. 1 having a clockwise oriented novel support structure adjacent to each of the corners of the faceplate.

A portion of the screen 32, partially covered by the mask 34, is illustrated in FIG. 2. The screen 32 comprises alternate lines 42 of red-, green- and blue-emitting phosphor elements. Also shown in FIG. 2 are four counterclockwise oriented novel mask-frame support means 44 (one of which is shown in FIG. 1) that suspend the mask-frame assembly 33 within the panel 22. Alternatively, four mask-frame support means 44′ can be disposed in a clockwise orientation, as shown in FIG. 3.

The frame 35 has an L-shaped cross-section with a first flange 46 extending toward the screen 32 and a second flange 48 extending inwardly toward the longitudinal axis (Z—Z) of the tube 18, as shown in FIG. 1. The frame 35 lies in a plane which is transverse to the longitudinal axis (Z—Z) of the tube 18. The frame 35 is substantially rectangular and comprises two oppositely disposed long sides and two oppositely disposed short sides. As shown in FIG. 2, the center of each long side of the frame 35 is bisected by the minor axis (Y—Y) of the panel 22, and the center of each short side of the frame 35 is bisected by the major axis (X—X) of the panel. The frame 35 is generally thicker than the mask 34 to provide adequate support for the latter.

Figure 4:
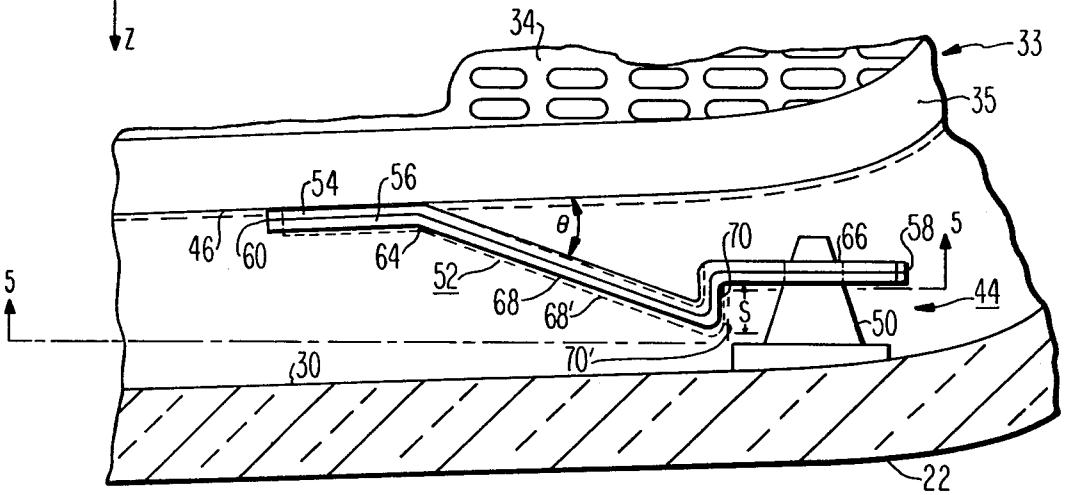
FIG. 4 is an enlarged plan view of a fragment of the faceplate and mask-frame assembly showing the improved bimetal spring of the novel support structure of FIG. 2.

As shown in FIG. 4, each mask-frame support means 44 includes a conventional metal stud 50 embedded into the sidewall 30 of the panel 22 adjacent to one of the corners thereof, and a novel resilient spring 52.

Figure 5:
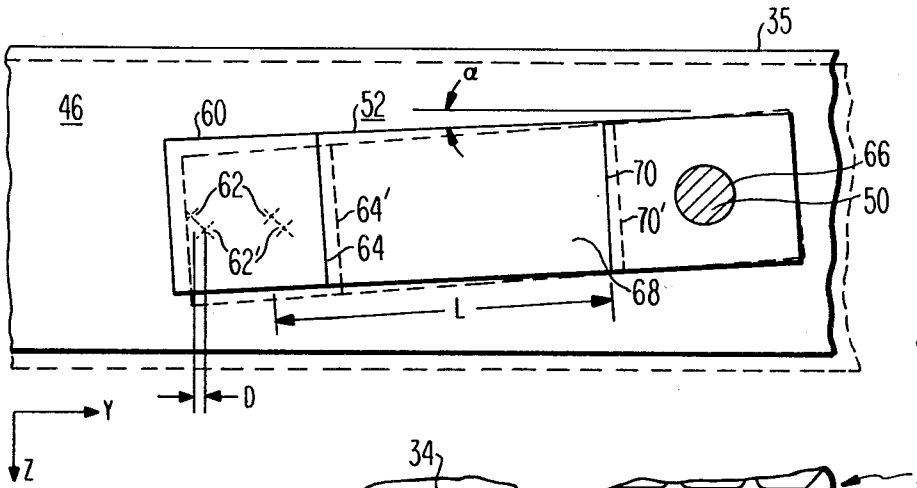
FIG. 5 is a side view taken along line 5—5 of FIG. 4.

Each spring 52 comprises a bimetal member of laminated, contiguous layer construction having a substantially rectangular configuration. The spring 52 includes a first metal layer 54 and a second metal layer 56. The first metal layer 54 has a lower coefficient of thermal expansion than the second metal layer 56. The spring 52 includes a distal end 58 and a proximal end 60. As shown in FIG. 5, the proximal end 60 is attached, for example by welding, to the first flange 46 of the frame 35 at a plurality of weld points 62 so that the lower coefficient of expansion metal layer 54 abutts the flange 46. The spring 52 is welded at an acute angle $\alpha$ with respect to the plane of the frame 35 to provide a component of motion longitudinally toward the screen. The spring 52 is bent outwardly, as shown in FIG. 4, at an acute angle $\theta$ to the flange 46 along a bend line 64. An aperture 66 is formed through the major surfaces of the distal end 58 of the spring 52. The aperture 66 is disposed over and pivotably engages the tapered end of the stud 50. A resilient portion 68 extends between the ends 58 and 60 of the spring 52. A step-like offset 70 of substantially constant width, s, is formed in the resilient portion 68 adjacent to the distal end 58 of the spring 52. Preferably, the step-like offset 70 is substantially perpendicular to the distal end 58 of the spring 52.

When the color picture tube 18 is operated, the mask-frame assembly 33 expands slightly, due to the heat produced by electron bombardment. The expansion also causes a rotation of the four-corner supported mask-frame assembly 33 such that the centers of the short and long sides of the assembly 33 are no longer aligned with the major and minor axes, respectively, of the panel 22. The expansion thus causes color impurity in the three-color picture on the screen 32 due to misalignment or misregister of the apertures in the mask 34 with the phosphor lines 42 on the screen. In order to eliminate or minimize such misregister, the mask-frame assembly is mounted on support means 44 which are adapted to cause the mask-frame assembly 33 to move toward the screen while expanding outwardly and to move in a compensating direction to offset the clockwise rotation induced by the four-corner mounted shadow mask support structure.

With reference to FIGS. 4 and 5, the bimetal layers 54 and 56 of spring 52 are chosen so that, when heated, the spring 52 will bend in the direction of the lower coefficient of expansion layer 54. However, the outward expansion of the mask-frame assembly 33 displaces the resilient portion 68 of the spring 52 radially outward to the heated location 68' shown by the dashed lines. The step-like offset 70 also bends in the direction of the lower coefficient of expansion layer 54, but since the aperture 66 is pivotably engaged with the stud 50, the bending translates to a displacement of the offset 70 to its heated location 70'. The offset 70 effectively produces a displacement in the counterclockwise direction in FIG. 4 (i.e., to the right) which compensates for the normal clockwise rotation of the four-corner mask-frame support means 44. Weld points 62 and bend line 64 are displaced a distance D to the right and toward the screen (Z direction) to locations 62' and 64', respectively. The longitudinal displacement toward the screen is governed by the angle $\alpha$ which must be different for the long and short sides of the frame 35. The width, s, of the offset 70 determines the amount of rotational compensation that is provided. The width, s, is adjusted for each size mask-frame assembly 33 so that the center point of each side of the frame has a compensating displacement which offsets the rotation introduced by the four-point corner adjacent support structure. In other words, the novel spring 52 with the offset 70 formed therein provides a null displacement between the center line of the long and short sides of the frame and the minor and major axes of the screen 32 so that no rotation of the mask-frame assembly 33 occurs relative to the axes of the screen 32.

By way of illustration, in the preferred embodiment the spring 52 has a thickness of about 0.76 mm (0.03 inches), equally divided between layers 54 and 56. The spring 52 has an effective length, L, defined as the distance from the step-like offset 70 to the nearest weld point 62 of typically 43 mm for the long side of the frame 35. The offset 70 has a width of about 3.05 mm and the welding angle $\alpha$ is about 26.6 degrees. At a temperature change of 30° C., the displacement of the spring 52 is about 0.1 mm to compensate for rotational effects and about 0.05 mm in the longitudinal direction.

In the alternative embodiment shown in FIG. 3, the mask-frame support means 44' are disposed in a clockwise orientation. When the color picture tube 18 is operated and the mask-frame assembly 33 expands due to the heat produced by electron bombardment, the location of the mask-frame support means 44' to the right of the major and minor axes produces a clockwise rotation of the mask-frame assembly 33 about the longitudinal axis (Z—Z) of the tube. In order to offset this clockwise rotation, the springs 52' are formed so that the first metal layer, having the lower coefficient of thermal expansion, is remote from the flange 46 of the frame 35, and the second metal layer, having the higher coefficient of thermal expansion, abuts the flange 46. This reversal of the bimetal members of spring 52' causes the offset 70 in the spring, upon heating, to expand, thereby producing a displacement in the counterclockwise direction which compensates for the clockwise rotation of the four-corner mask-frame support means 44'.

What is claimed is:

1. In a color picture tube of the type including an evacuated envelope enclosing a substantially rectangular cathodoluminescent screen, a color selection electrode suspended in register with said screen by support means and an electron gun, said support means comprising a plurality of studs attached to said envelope adjacent to the corners of said screen and a plurality of springs connecting said color selection electrode to said studs, the improvement comprising each of said springs being a bimetal member of laminated construction having two layers of dissimilar metal joined along facing surfaces, each of said springs having a proximal end attached at an angle to said color selection electrode and a distal end with an aperture therein pivotably engaging one of said studs, each of said springs including a step-like portion formed therein adjacent to said distal end, said springs providing longitudinal and rotational compensation thereby maintaining said color selection electrode in register with said screen when said color selection electrode and said springs are heated.

2. The tube as in claim 1 wherein said step-like portion has a substantially constant width.

3. In a color picture tube of the type including an evacuated envelope enclosing a substantially rectangular cathodoluminescent screen, an electron gun and a low expansion apertured mask attached to a frame which is suspended in relation to said screen by support means, an axis passing through the center of said electron gun and the center of said screen being the longitudinal axis of said tube, said screen also including a major axis and a minor axis which are perpendicular to each other and perpendicular to said longitudinal axis, said support means comprising four studs attached to said envelope adjacent to the corners of said screen and four springs connecting said frame to said studs, the improvement comprising each of said springs being a bimetal member of laminated construction having two layers of dissimilar metal joined along facing surfaces, each of said springs having a proximal end attached at an angle to said frame and a distal end with an aperture therein pivotably engaging one of said studs, each of said springs including a step-like portion having a substantially constant width formed therein adjacent to said distal end, said springs providing longitudinal and rotational compensation thereby maintaining said apertured mask in register with said screen when said mask, said frame and said springs are heated.

4. In a color picture tube of the type including an evacuated envelope enclosing a substantially rectangular cathodoluminescent screen, an electron gun for generating and directing a plurality of electron beams, and a low expansion apertured mask attached to a substantially rectangular low expansion frame lying in a plane, said frame having two oppositely disposed long sides and two oppositely disposed short sides, said mask and frame being suspended in relation to said screen by support means, an axis passing through the center of said electron gun and the center of said screen being the longitudinal axis of said tube, said screen also including a major axis and a minor axis which are perpendicular to each other and perpendicular to said longitudinal axis, said major axis being aligned with the center of each of said short sides of said frame and said minor axis being aligned with the center of each of said long sides of said frame, said support means comprising four studs attached to said envelope adjacent to the corners of said screen and four springs connecting said frame to said studs, the improvement comprising each of said springs including a bimetal member of laminated construction having two layers of dissimilar metal with different coefficient of thermal expansion, said layers being joined along facing surfaces, each of said springs having a proximal end and a distal end, said proximal end being attached to said frame at an acute angle with respect to the plane of said frame, said distal end of each of said springs having an aperture therein pivotably engaging a different one of said studs, each of said springs including a step-like portion of substantially constant width formed therein adjacent to said distal end, said springs providing longitudinal and rotational compensation for the radial expansion and rotation of said mask and frame occasioned by the impact on said mask of said electron beams, said springs having a longitudinal component of expansion provided by the attachment angle to said frame and a transverse component of expansion provided by said offset which maintains the center of the long and short sides of said frame in alignment with the major and minor axes of said screen, respectively, thereby maintaining said apertured mask in register with said screen when said mask, said frame and said springs are heated.

* * * * *